US005599218A

United States Patent [19]

Schmidt et al.

[11] Patent Number: 5,599,218

[45] Date of Patent: Feb. 4, 1997

[54] CONFIGURATION FOR A MARINE ENGINE EXHAUST SYSTEM

[75] Inventors: Keith W. Schmidt; Brian R. White, both of Stillwater, Okla.; Howard F. Africa, Oceanside, Calif.

[73] Assignee: Brunswick Corporation, Lake Forest, Ill.

[21] Appl. No.: 623,730

[22] Filed: Mar. 29, 1996

Related U.S. Application Data

[63] Continuation of Ser. No. 441,919, May 16, 1995, abandoned, which is a continuation of Ser. No. 243,402, May 16, 1994, Pat. No. 5,462,465.

[51] Int. Cl.[6] ..... B63H 21/30

[52] U.S. Cl. ..... 440/89; 440/111

[58] Field of Search ..... 440/75, 89, 111, 440/112, 88; 114/65 R, 270

[56] References Cited

U.S. PATENT DOCUMENTS

| | | | |
|---|---|---|---|
| 890,014 | 6/1908 | Barbour | 440/89 X |
| 2,059,220 | 11/1936 | Fernstrum | 440/111 |
| 3,853,085 | 12/1974 | Halboth | 114/270 |
| 4,778,420 | 10/1988 | Greenberg | 440/111 |
| 4,831,822 | 5/1989 | Yoshimura | 440/89 |
| 4,927,390 | 5/1990 | Kudoh et al. | 440/88 |
| 5,129,479 | 7/1992 | Fujii et al. | 248/659 X |

FOREIGN PATENT DOCUMENTS

| | | | |
|---|---|---|---|
| 0163998 | 12/1981 | Japan | 140/111 |
| 0185000 | 8/1987 | Japan | 440/75 |

OTHER PUBLICATIONS

Quicksilver Parts Catalog, "5.7 Litre Competition Ski Engine", Parts No. 90–17740; Revised Jan. 1989.

*Primary Examiner*—Sherman Basinger
*Attorney, Agent, or Firm*— Andrus, Sceales, Starke & Sawall

[57] ABSTRACT

A marine transmission mounting system for marine engine and drive that are mounted in a mid-travel position to joists in the hull space between a hull and a floor of the boat. Such a system is typically used on a competition water-ski boat where the engine, transmission, and propeller shaft are mounted in-line at a downward angle with respect to a floor of the boat such that the propeller shaft passes through the hull of the boat in front of the transom. The transmission mounting system includes a transmission mounting bracket having reinforcement webs located above the span of the bracket so that smaller reinforcement webs can be located below the span of the bracket. With such a bracket, there is sufficient room underneath the bracket so that an engine exhaust tube can pass under the bracket. This allows overall engine and exhaust system space requirements above the floor of the boat to be reduced.

3 Claims, 4 Drawing Sheets

FIG. 1
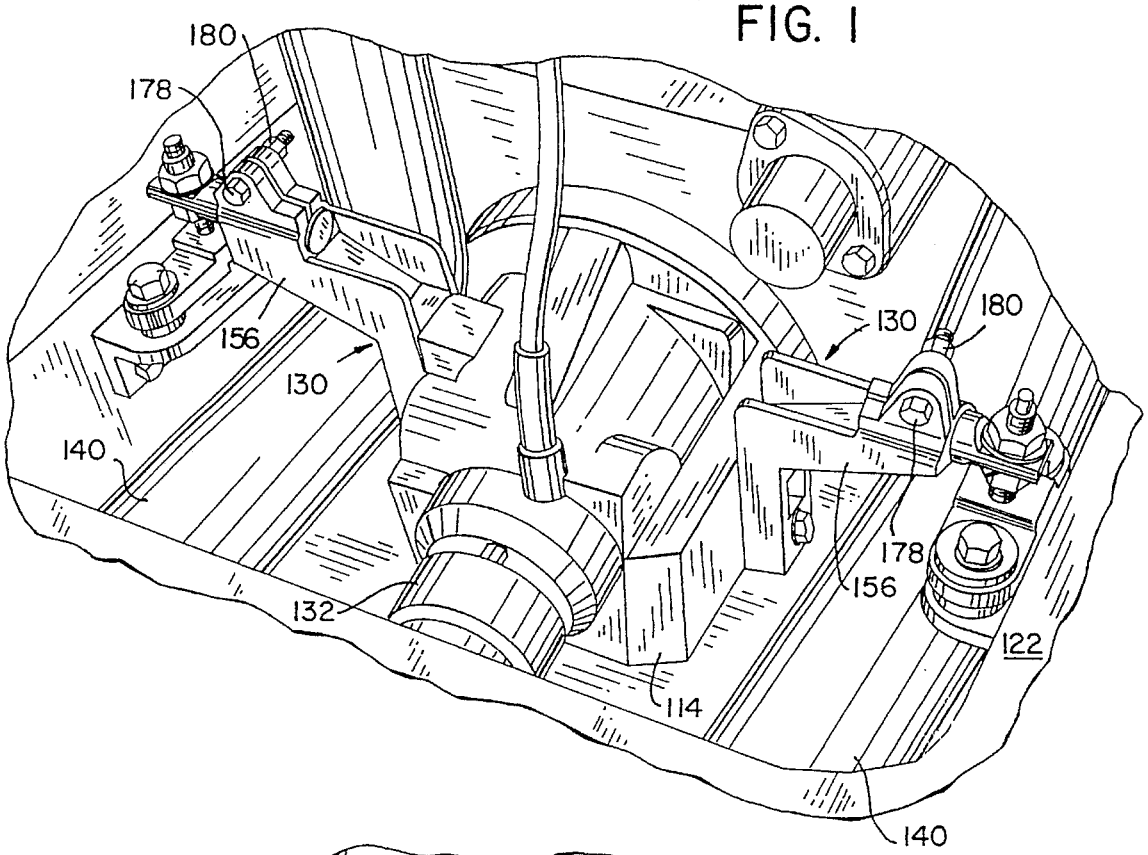
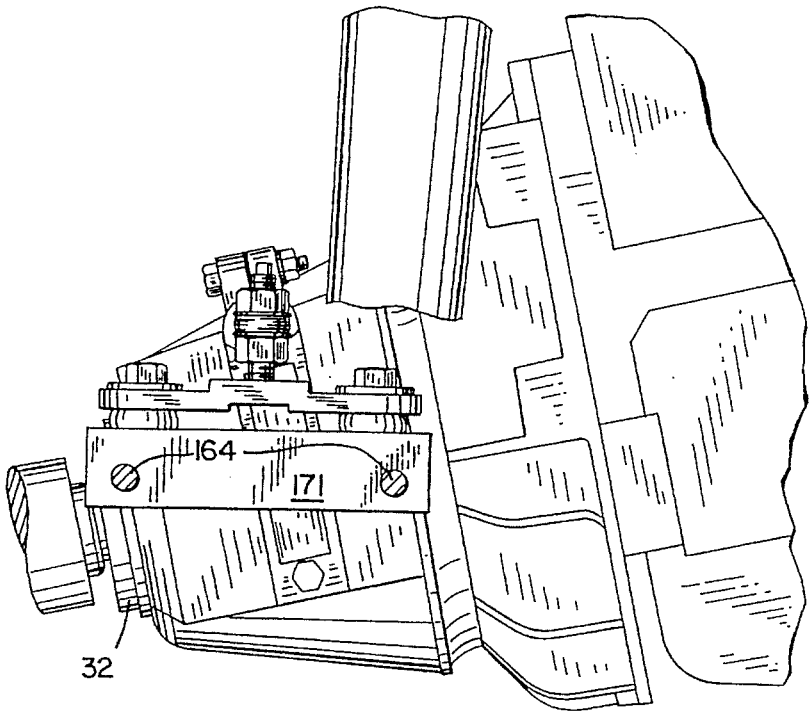
FIG. 2

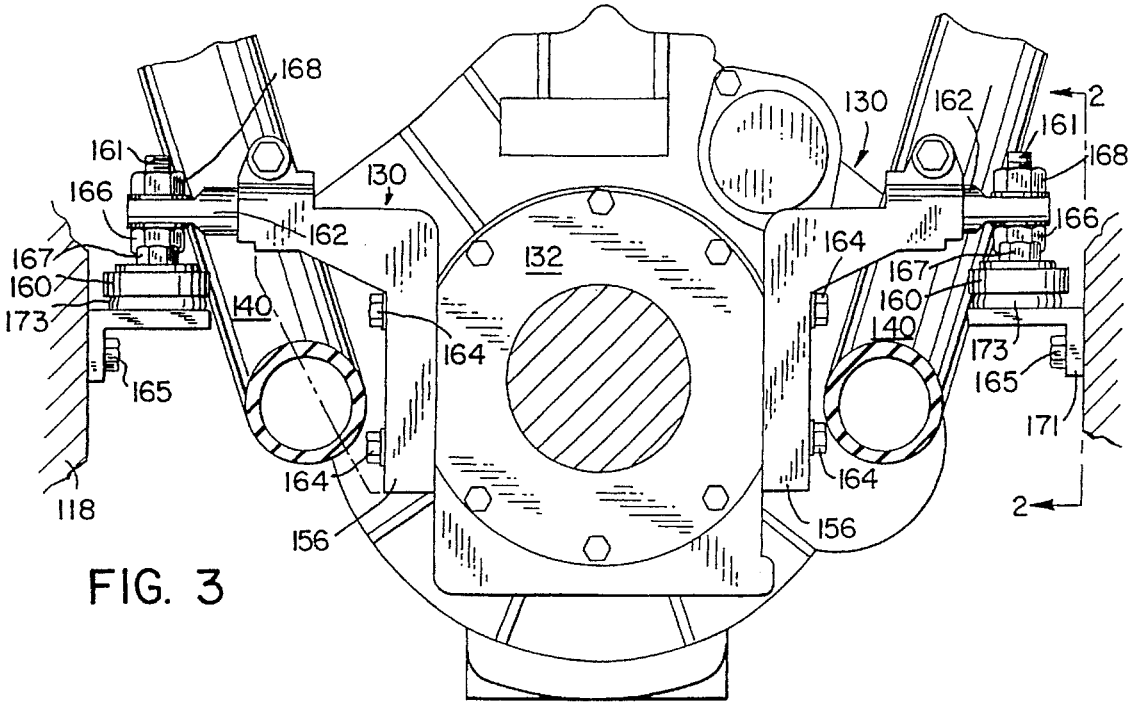
FIG. 3
FIG. 4
(PRIOR ART)
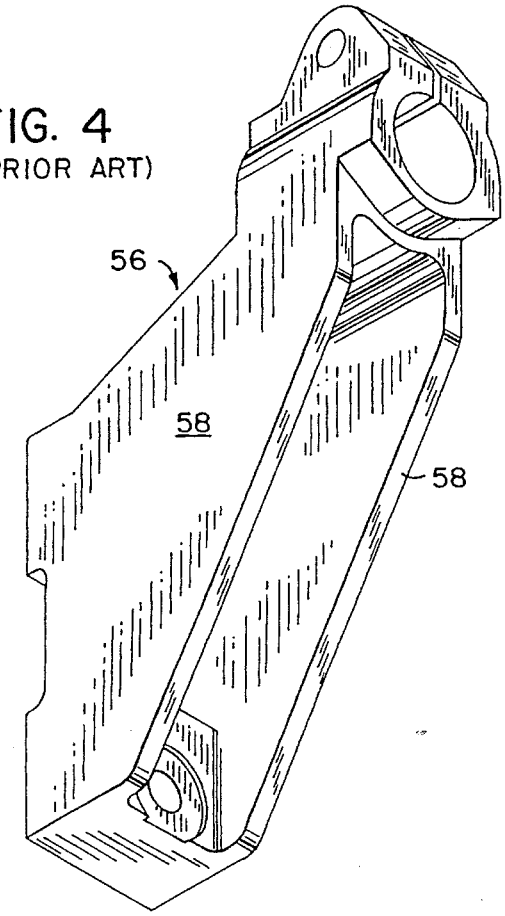
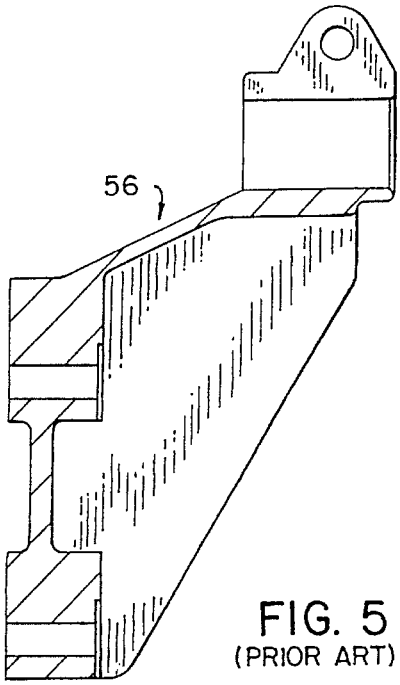
FIG. 5
(PRIOR ART)

FIG. 6
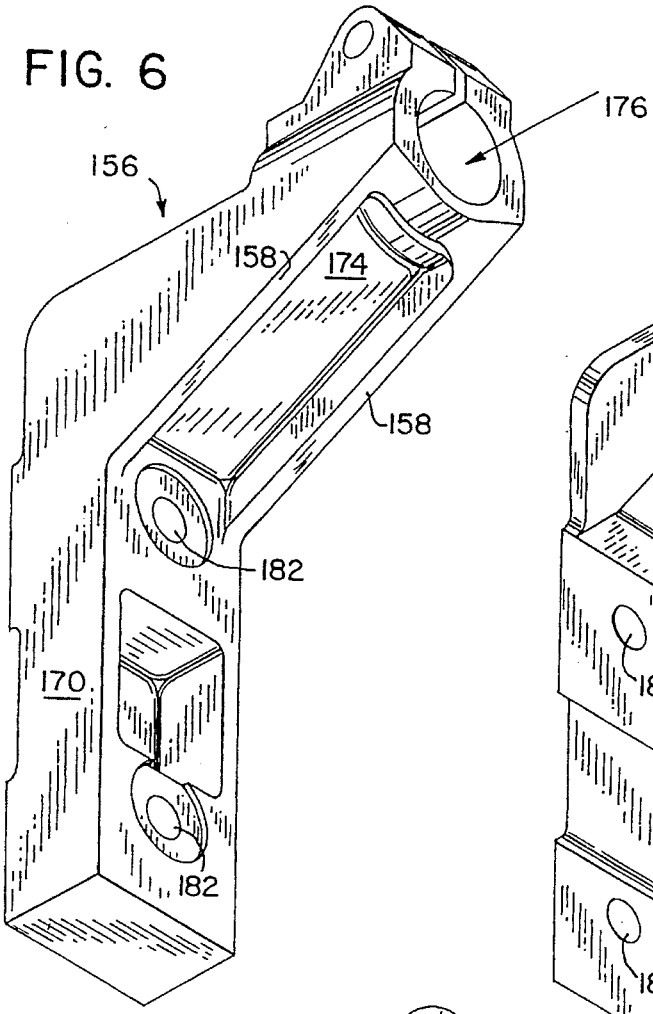
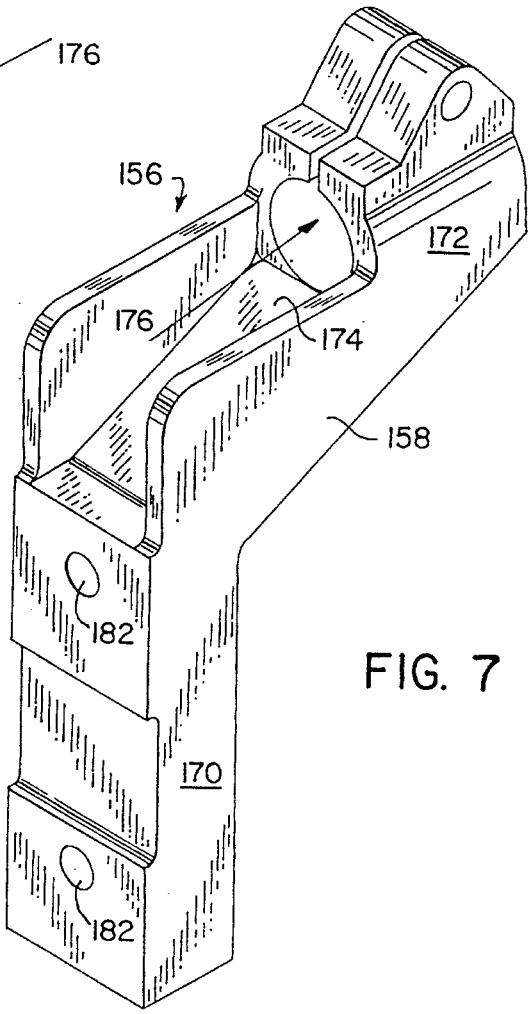
FIG. 7
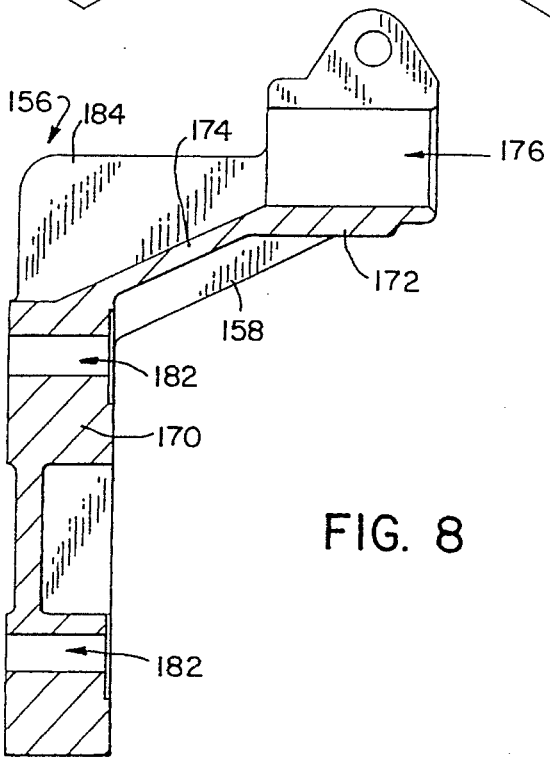
FIG. 8

CONFIGURATION FOR A MARINE ENGINE EXHAUST SYSTEM

This is a continuation of application Ser. No. 08/441,919 filed on May 16, 1995, now abandoned, which is a continuation of Ser. No. 243,402 filed on May 16, 1994 and now U.S. Pat. No. 5,462,465 issued on Oct. 31, 1995.

FIELD OF THE INVENTION

The invention relates to a system for mounting a transmission for an inboard marine engine in a boat. In particular, the invention relates to transmission mounts that allow an engine exhaust system to be tightly packaged to the engine. The invention is particularly useful for reducing the amount of room that an engine in a competition ski boat occupies above a floor of the boat.

BACKGROUND OF THE INVENTION

Competition ski boats normally have a powerful (i.e., 250–400HP and above) inboard engine mounted in a mid-travel position. That is, the engine is located directly behind the driver and front passenger seats in a hump mostly above the floor of the boat. Mounting the engine in the mid-travel position leaves room available rearward of the engine near the transom of the boat for passengers to maneuver when attending water-skiers. In such a system, it is typical that the engine, the transmission, and the propeller shaft are mounted in-line at a downward angle of about 12 degrees to the hull of the boat, such that the propeller shaft exits rearward through the hull at the 12 degree angle.

A propeller is rotated by the propeller shaft, and because of the 12 degree downward angle, the propeller not only thrusts the boat forward, but also pushes in part upward on the boat so that the boat can be lifted to plane quicker. It is useful for the propeller to be located forward of the transom underneath the hull of the boat to reduce turbulence behind the boat. Steering in such a system is normally accomplished using one or more rudders attached to the transom.

The transmission receives an engine crankshaft, and the propeller shaft is coupled to the other end of the transmission by a transmission coupler. The engine and the transmission are mounted to joists or studs located in a hull space of the boat, which is in between the hull and the floor of the boat. It is extremely important that mounts for the engine and the transmission be strong and adjustable. Strength and adjustability are important because the crankshaft of the engine, the transmission, and the propeller shaft must remain in line even when subjected to extreme forces. Extreme forces on the mounts are possible because ski boats have high power requirements both at start up and when operating at high speeds.

As noted above, the engine is located in a hump behind the driver and front passenger seats when the engine and transmission are mounted in the mid-travel position. It is desirable to reduce the size of the engine hump without reducing the performance and power capacities of the engine.

SUMMARY OF THE INVENTION

The present invention uses a transmission mounting bracket designed so that exhaust tubes can pass thereunder, without compromising the strength of the transmission mounting bracket. Thus, the present invention allows the engine exhaust system to be more tightly packaged to the engine thus reducing the size of the engine hump in a competition ski boat without reducing the engine performance.

In one aspect, the present invention is an exhaust system for a marine engine and drive that are mounted in a mid-travel position to joists in the hull space between a hull and a floor of a boat. The exhaust system has an exhaust manifold that collects engine exhaust from the engine and directs the exhaust to an upwardly facing opening. The exhaust system also has an exhaust elbow that redirects exhaust rearward from the upwardly facing opening of the manifold, and an exhaust tube that is connected to the exhaust elbow and directs exhaust from the exhaust elbow to the transom of the boat. In particular, the exhaust tube passes below a transmission mount that mounts an engine transmission to the joist of the boat. Such a configuration allows an exhaust tube to be tightly packaged to the engine.

In another aspect, the invention is a transmission mounting system that mounts a marine transmission to a joist of a boat. The system has a mount base that is secured to a joist of a boat and has an upwardly extending stud. The system has a trunion that has an opening on one side to receive the stud. The system also has a transmission mounting bracket for mounting the transmission to the trunion. The transmission mounting bracket has a transmission attachment portion that can be attached to the transmission using bolts. The transmission mounting bracket also has a trunion receiving portion that has an opening to receive the trunion and a spanning portion that spans between the transmission attachment portion and the trunion receiving portion. A reinforcement web is located above the spanning portion. Since the reinforcement web is located above the spanning portion, a large reinforcement web located below the spanning portion is not required, and this means that there is room tier the exhaust tube to pass under the transmission mounting bracket.

It is an object of the invention to provide an engine exhaust system that can be tightly packaged to the engine.

Another object of the invention is to do the same, without compromising the strength of the mounts which mount the transmission to the joists or studs in the hull space of a boat.

Another object of the present invention is to provide an improved transmission mounting system wherein the vertical and lateral positions of the transmission with respect to the joists in the hull of the boat are adjustable.

BRIEF DESCRIPTION OF THE DRAWINGS

FIG. 1 is a perspective view of a transmission being mounted in accordance with the present invention.

FIG. 2 is a side elevational view of a transmission being mounted in accordance with the present invention.

FIG. 3 is a front elevational view of a transmission being mounted in accordance with the present invention.

FIG. 4 is a perspective view of a prior an transmission mounting bracket.

FIG. 5 is a sectional view of the prior art bracket shown in FIG. 4.

FIG. 6 is a perspective view taken from below a transmission mounting bracket in accordance with the present invention.

FIG. 7 is a perspective view taken from above the transmission mounting bracket shown in FIG. 6.

FIG. 8 is a sectional view of the transmission mounting bracket shown in FIG. 6 and 7.

DETAILED DESCRIPTION Prior Art

Figure 9:
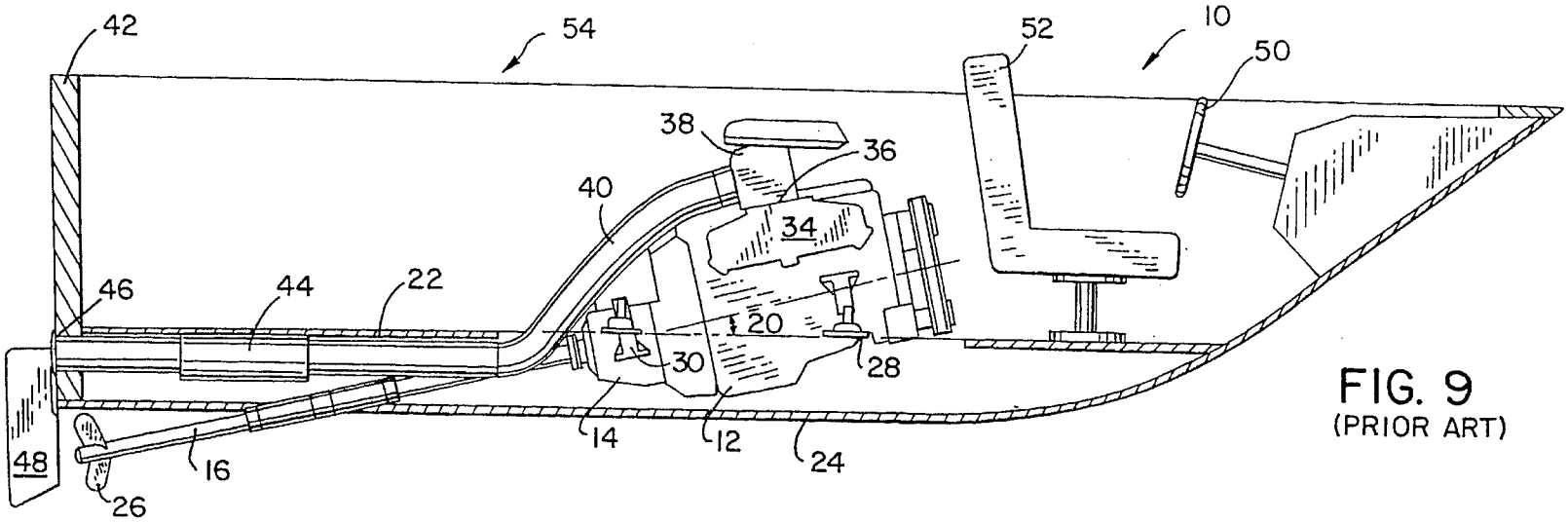
FIG. 9 (PRIOR ART)
FIG. 9 is a schematic drawing of a prior art engine and drive system mounted in the mid-travel position.

A water ski boat 10 having a prior art engine exhaust system is depicted in FIG. 9. In FIG. 9, an engine 12, a transmission 14 and a propeller shaft 16 are mounted to joists in a mid-travel position. The engine 12, the transmission 14, and propeller shaft 16 are mounted in line with one another at a 12 degree downward angle to the floor 22 of the boat. The propeller shall 16 extends through the hull 24 of the boat 10. A propeller 26 is attached to the end of the propeller shaft. The engine 12 is mounted to a joist on both sides of the engine 12 using two engine mounts 28 which are symmetrically located. The transmission 14 is mounted to a joist on both sides of the transmission using two transmission mounts 30 which are also symmetrically located.

In operation, the engine 12 rotates a crankshaft (not shown) that is received in the transmission 14. The propeller shaft 16 is coupled to the transmission 14 using a transmission coupler (like number 132 in FIGS. 1, 2, and 3). It is extremely critical that the propeller shaft 16 be properly aligned to the transmission coupler. The propeller shaft must not be offset, nor must there be any angular misalignment.

The engine 12 shown in FIG. 9 is a V-8 engine. Exhaust from each side of the engine 12 is exhausted into an engine manifold 34. The engine manifold 34 has an upwardly facing exhaust opening 36. Exhaust passes through the exhaust opening 36 into an exhaust elbow 38. In the exhaust elbow 38, the exhaust is directed rearward. From the exhaust elbow 38, the exhaust is directed into an exhaust tube 40. The exhaust tube 40 angles downward as the tube 40 extends rearward until the tube 40 is under the floor 22 of the boat 10. The exhaust tube 40 then extends rearward in the hull space between the floor 22 and the hull 24 of the boat through the transom 42 of the boat. A muffler 44 is typically provided to reduce noise. A baffle 46 is typically provided to prevent water from backflowing into the exhaust system.

The boat 10 is steered using a rudder 48 attached to the transom 42. The rudder 48 can be controlled by a driver sitting in the driver's seat 52 using the steering wheel 50. With such a system, there is typically sufficient maneuvering room in the area shown by arrow 54 for a passenger in the boat to attend water-skiers.

As shown in FIG. 9, the exhaust tube 40 passes above the transmission mount 30. The primary reason for this is that in the system shown in FIG. 9 there is insufficient room underneath the transmission mount 30 for the exhaust tube 40 to pass. Referring to FIGS. 4 and 5, a prior art transmission mounting bracket 56 is shown. The transmission mounting bracket shown in FIGS. 4 and 5 has large webs 58 to reinforce the transmission mounting bracket 56. The webs 58 are important because the bracket 56 must be strong, even under extreme forces so that the transmission 14 remains in line with both the engine 12 crankshaft and the propeller shaft 16. However, with large webs 58, the exhaust tube 40 cannot fit underneath the transmission bracket 56. Thus, the exhaust tube 40 must pass over the transmission mount 30, and this means that the engine exhaust system occupies more of the maneuvering room in the boat.

PRESENT INVENTION

Figure 10:
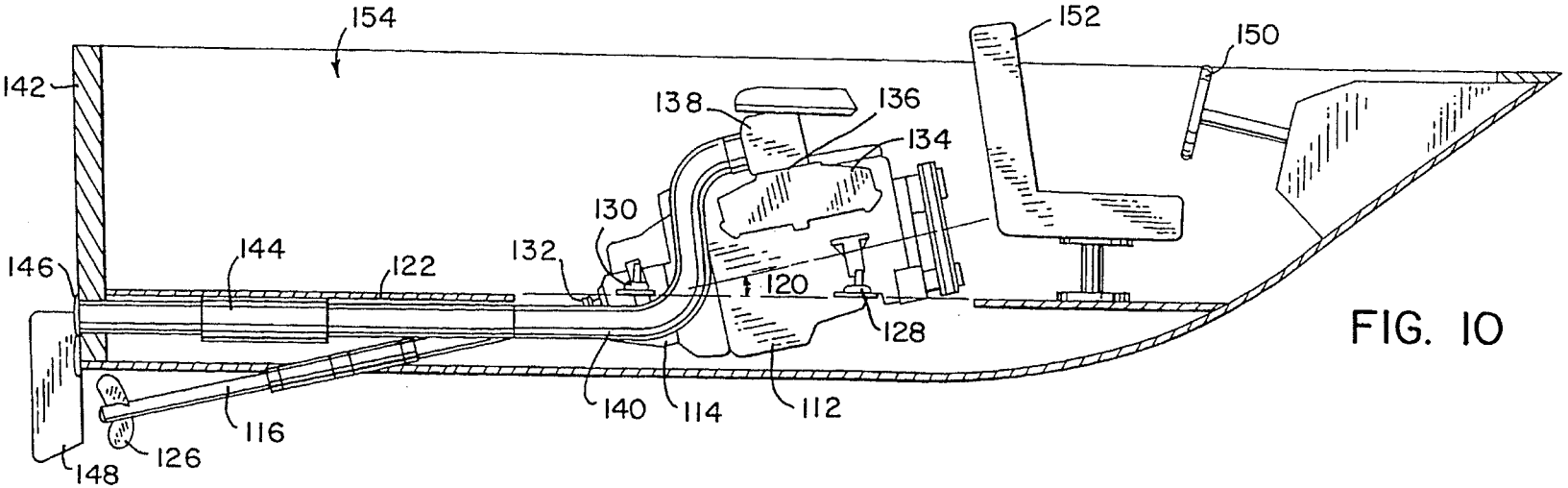
FIG. 10 is a schematic drawing showing an engine and drive system that is mounted in the mid-travel position in accordance with the present invention.

A water-ski boat 110 in accordance with the present invention is depicted in FIG. 10. As in the prior art boat 10 shown in FIG. 9, the boat 110 has an engine 112, a transmission 114, and a propeller shaft 116 mounted in a mid-travel position, and in line at a 12 degree downward angle 120. The transmission 114 depicted in the drawings is a direct drive in-line transmission. The engine 112 depicted in the drawings is a V-8 engine. The boat 110 is steered using a rudder 148 which can be controlled by a driver sitting in driver's seat 152 and using steering wheel 150.

The engine 112 is mounted to joists in the boat 110 using engine mounts 128. The transmission 114 is mounted to joists in the boat with transmission mounts 130. Engine exhaust flows from the engine 112 into an engine manifold 134. The exhaust flows from the engine manifold 134 through a top opening 136 in the manifold 134 and into an exhaust elbow 138. The exhaust elbow 138 directs the exhaust rearward and into an exhaust tube 140. The exhaust tube 140 in the present invention directs the exhaust from the exhaust elbow 138 down under the floor 122 of the boat and rearward under the floor 122 out through the transom 142. In the present invention, the exhaust tube 140 is tightly packaged to the engine 112 and passes underneath the transmission mount 130 as it extends rearward toward the transom 142. A muffler 144 is located in the exhaust tube 140 rearward of the transmission mount 130. A baffle 146 is also located in tube 140 to keep water from back flowing into the exhaust system. In the present invention as depicted in FIG. 10, the exhaust tube 140 is more tightly packaged to the engine 112 than in the prior art system depicted in FIG. 9. This means that there is more maneuvering room 154 in a boat 110 embodying the present invention than in the prior art boat 10 as shown in FIG. 9.

Referring to FIGS. 1 through 3, two transmission mounting systems 130 are used to mount the transmission 114 to joists 118 in the hull space of the boat 110. The transmission mounting system 130 includes a mounting base 160 having an upwardly extending threaded stud 161, a trunion 162 and a transmission mounting bracket 156. The transmission mounting system also has attachment bolts 164,165,167, adjustment nuts 166, and securing nuts 168.

The mounting base 160 is securely attached to the joist 118 using an angle bracket 171. The angle bracket 171 is attached to the joist 118 using bolts 165. The mounting base 160 is attached to the angle bracket 171 using attachment bolts 167. A rubber mounting washer 173 is used with attachment bolts 167, and is located between the mounting base 160 and the angle bracket 171. The mounting base 160 has an upwardly facing threaded stud 161 onto which an adjustment nut 166 is screwed. A trunion 162 has an opening through one end that slides over the upwardly facing threaded stud 161. The trunion rests on the adjustment nut 166. The nut 166 can be raised and lowered by screwing the nut 166 around the stud 161, and in this manner the height of the trunion 162 can be adjusted. The trunion 162 is secured to the upwardly facing threaded stud 161 using securing nut 168. The trunion 162 extends inward from the threaded stud 161 where the trunion 162 is received in the transmission mounting bracket 156. The transmission mounting bracket 156 is securely attached to the transmission 114 using attachment bolts 164.

Referring in particular to FIGS. 6 through 8, the transmission mounting bracket 156 has a transmission attachment portion 170, a trunion receiving portion 172 and a spanning portion 174 that spans between the transmission attachment portion 170 and the trunion receiving portion 172. The trunion receiving portion 172 has a cylindrical opening 176 for receiving the trunion 162. Since the trunion 162 and the opening 176 are preferably cylindrical, and are preferably perpendicular to the in-line axis of the engine 112, the transmission 114 and the propeller shaft 116, the transmission 114 can be aligned by rotating the transmission 114 around the trunions 162. Also, the adjustment nuts 166 can be raised or lowered to facilitate proper alignment of the propeller shaft 116 to the transmission coupler 132, and the transmission 114 to the engine 112 crankshaft. The opening 176 in the trunion receiving portion 172 of the transmission mounting bracket can be squeezed together using a nut 178 and a bolt 180 (as shown in FIG. 1 ) so that the trunion 162 can be tightly gripped in the opening 176. The transmission attachment portion 170 of the transmission mounting bracket 156 is attached to the transmission 114 using two attachment bolts 164 through holes 182. In this manner, the transmission attachment portion 170 is securely fastened to the transmission 114, and the trunion receiving portion 172 is securely fastened to the trunion 162.

The spanning portion 174 of the transmission mounting brackets 156 connects the attachment portion 170 to the trunion receiving portion 172. The spanning portion 174 must be long enough so that the transmission mounting bracket 156 can span from the trunion 162 to the transmission 114 (a sufficient portion of the trunion 162 must be received in the opening in the trunion receiving portion 172). The spanning portion 174 may not be strong enough to withstand the extreme forces that impact the bracket 156 without reinforcing the portion 174. Therefore, a lower reinforcement web 158 and an upper reinforcement web 184 are used to increase the strength of the span 174 between the trunion receiving portion 172 and the attachment portion 170. By using the upper reinforcement web 184, the lower reinforcement web 158 can be made significantly smaller without running the risk of reducing the amount of reinforcement in the spanning portion 174 enough so that the integrity of the transmission mounting bracket 156 may be compromised by the forces acting on the bracket 156.

Because the bracket 156 of the present invention can use a lower web 158 that has smaller dimensions, it is possible to run the exhaust tube 140 below the bracket 156. In this manner, the exhaust tube 140 can be packaged more tightly to the engine 112, and this can reduce the volume which the engine 112 occupies.

Note that the upper web 184 preferably has a somewhat triangular shape, whereas the lower web 158 is substantially parallel to the span 174. This is preferred because it is desired to leave as much space as possible below the bracket 156 available for the exhaust tube 140. On the other hand, the upper web 184 should be relatively large to provide sufficient reinforcement.

It is preferred that all parts of the transmission mounting system that have been referenced herein be made of steel. Boat joists are typically made of wood.

It is recognized that various equivalents, alternatives and modifications are possible and should be considered to be within the scope of the claims.

I claim:

1. In a boat having a marine engine and an engine transmission that are mounted to joists in a hull space between a hull and a floor of the boat, the marine engine and engine transmission being mounted in a mid-travel position which is behind a driver seat in the boat and forward of a transom of the boat to leave space available rearward of the engine to attend water skiers, an improved engine exhaust system comprising:

an exhaust manifold that collects exhaust from the engine and directs the exhaust to an upwardly facing opening;

an exhaust elbow that redirects the exhaust rearward from the upwardly facing opening of the manifold; and an exhaust tube connected to the exhaust elbow that directs the exhaust from the exhaust elbow to the transom of the boat, the exhaust tube passing rearward of the engine from the exhaust elbow and underneath a transmission mount that mounts the engine transmission to one of the joists of the boat located in the hull space between the hull and the floor of the boat.

2. An exhaust system in a boat as recited in claim 1 wherein the marine engine is mounted to the joist so that an axis of rotation of an engine crankshaft is at a downward angle relative to the hull of the boat, and the transmission and a propeller shaft are mounted substantially in line with the crankshaft.

3. An exhaust system in a boat as recited in claim 1 wherein the exhaust robe is located completely in the hull space between the floor and the hull of the boat after the exhaust robe passes rearward underneath the transmission mount.

* * * * *